US007324059B2

(12) United States Patent
Lee et al.

(10) Patent No.: US 7,324,059 B2
(45) Date of Patent: Jan. 29, 2008

(54) STUB PRINTED DIPOLE ANTENNA (SPDA) HAVING WIDE-BAND AND MULTI-BAND CHARACTERISTICS AND METHOD OF DESIGNING THE SAME

(75) Inventors: Sung-Jun Lee, Gyeonggi-do (KR); Kwang-Chun Lee, Daejeon (KR)

(73) Assignee: Electronics and Telecommunications Research Institiute, Daejeon (KR)

( * ) Notice: Subject to any disclaimer, the term of this patent is extended or adjusted under 35 U.S.C. 154(b) by 0 days.

(21) Appl. No.: 11/504,512

(22) Filed: Aug. 15, 2006

(65) Prior Publication Data

US 2007/0040759 A1 Feb. 22, 2007

(30) Foreign Application Priority Data

Aug. 19, 2005 (KR) ..... 10-2005-0076503
Nov. 11, 2005 (KR) ..... 10-2005-0108100

(51) Int. Cl.
*H01Q 9/18* (2006.01)

(52) U.S. Cl. ..... 343/795; 343/793; 343/700 MS

(58) Field of Classification Search ..... 343/700 MS, 343/793, 795, 812
See application file for complete search history.

(56) References Cited

U.S. PATENT DOCUMENTS 6,791,506 B2 9/2004 Suganthan et al.
2002/0084943 A1* 7/2002 Tsai et al. ..... 343/795
2006/0187135 A1* 8/2006 Maniwa et al. ..... 343/795
2007/0024517 A1* 2/2007 Shimoda ..... 343/795
2007/0052610 A1* 3/2007 Lee ..... 343/795

OTHER PUBLICATIONS

Tefiku, F., et al. "Design of Broad-Band and Dual-Band Antennas Comprised of Series-Fed Printed-Strip Dipole Pairs". *IEEE Transactions on Antennas and Propagation*. 2000. 48:895-900.

Chen, H., et al. "Feed for dual-band printed dipole antenna". *Electronics Letters*. 2004. 40:1320-1322.

Chen, G., et al. "A printed dipole antenna with microstrip tapered balun". *Microwave and Optical Technology Letters*. 2004. 40:344-346.

* cited by examiner

*Primary Examiner*—Trinh Vo Dinh
(74) *Attorney, Agent, or Firm*—Ladas & Parry LLP

(57) ABSTRACT

A stub printed antenna (SPDA) and a method of designing the same are provided. The SPDA include: a substrate; dipole arms disposed at both surfaces of the substrate for transmitting/receiving a signal; a parallel metal strip line disposed at both surfaces of the substrate, and each having one end connected to each of the dipole arms; a stub disposed at both surfaces of the substrate, and connected to the other end of the parallel metal strip line; a coaxial probe connected to the junction of the parallel metal strip line and the stub for feeding signals; a hole for inserting an inner conductor of the coaxial probe; and a contact for connecting to an outer conductor of the coaxial probe.

11 Claims, 13 Drawing Sheets

FIG. 2
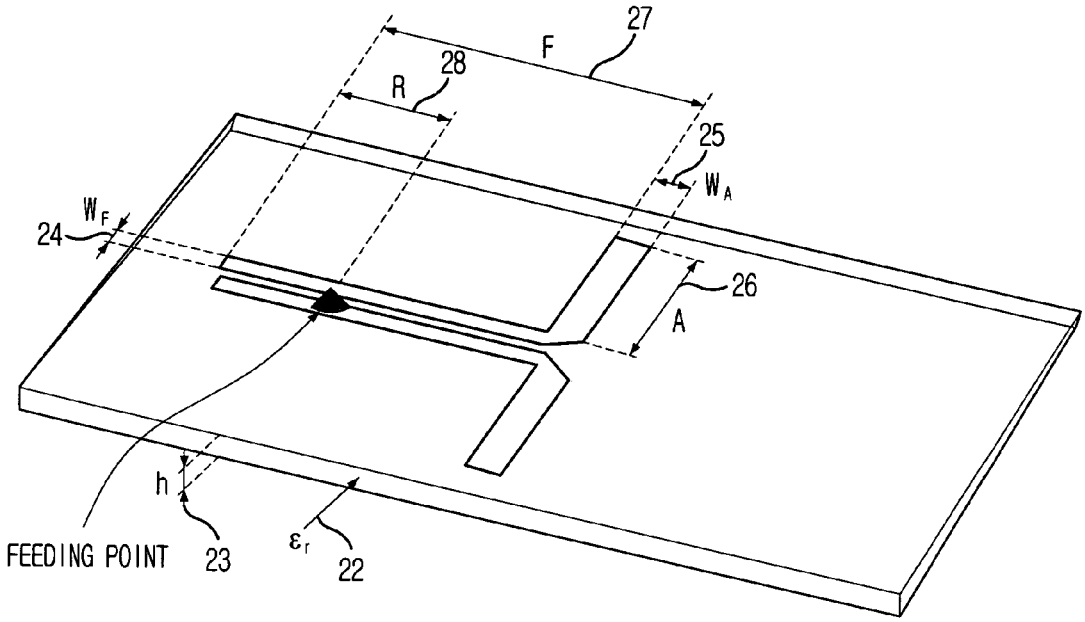
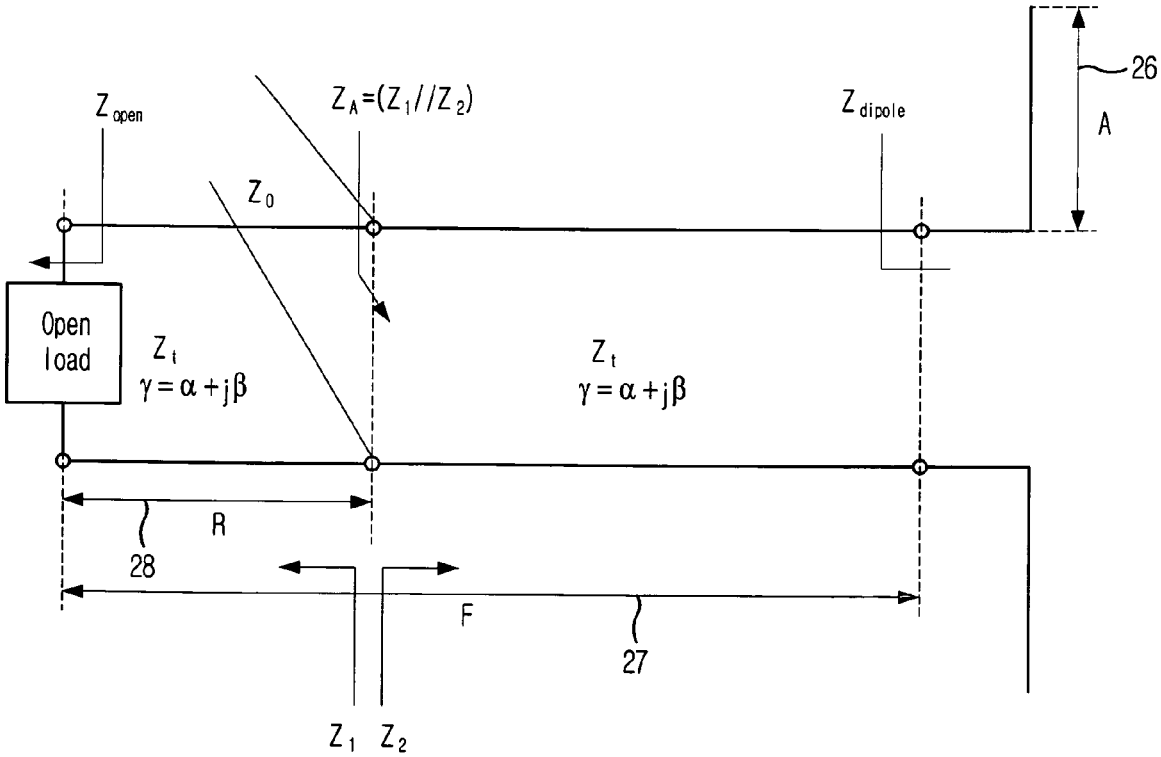

FIG. 4
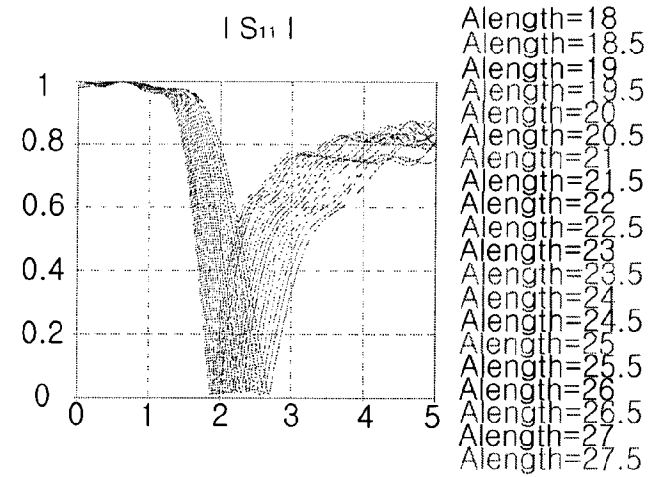
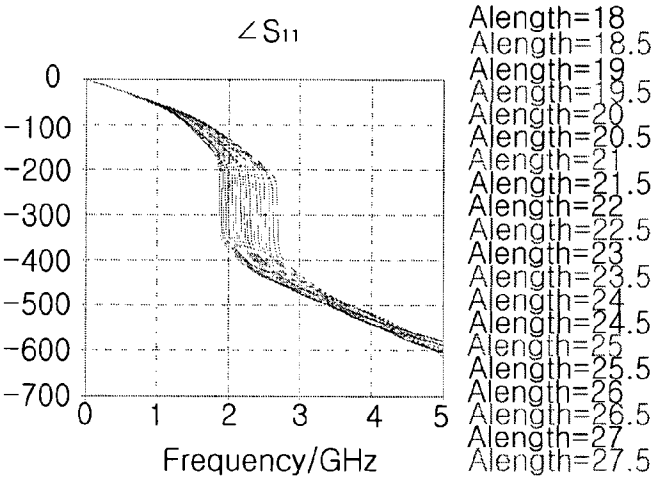
< S11(f) ACCORDING TO VARIATION OF A>
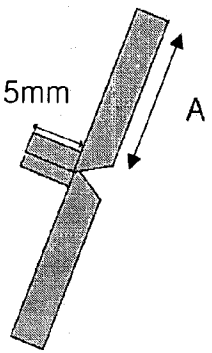
<REFERENCE DIPOLE >

FIG. 6

<INPUT 1>

Input for Stub Dipole Optimize

Select the target frequency (GHz) in row vector format

[1.90,2.72]

Select the threshold value at target frequencies(dB)

-15

Select the T_line impedance 58.4

OK Cancel

<OUTPUT 1-parameter.txt>

| A | F | R | MAXIMUM REFLECTION COEFFICIENT AT FREQUENCY OF REQUIRED SPECIFICATION |
|---|---|---|---|
| 24.5 | 22.9 | 7.7 | -15.44 |
| 24.5 | 22.95 | 7.5 | -15.19 |
| 24.5 | 22.95 | 7.6 | -15.56 |
| 24.5 | 22.95 | 7.7 | -15.95 |
| 24.5 | 22.95 | 7.8 | -15.08 |
| 24.5 | 23 | 7.5 | -15.04 |
| 24.5 | 23 | 7.6 | -15.4 |
| 24.5 | 23 | 7.7 | -15.78 |
| 24.5 | 23 | 7.8 | -15.61 |
| 24.5 | 23.05 | 7.6 | -15.24 |
| 24.5 | 23.05 | 7.7 | -15.61 |
| 24.5 | 23.05 | 7.8 | -16 |

<INPUT 2>

Input for Stub Dipole Verify

Select the Alength(mm)

24.5

Select the Flength(mm)

23

Select the Roffset(mm)

7.5

Select the T_line impedance 58.4

OK Cancel

<OUTPUT 2>

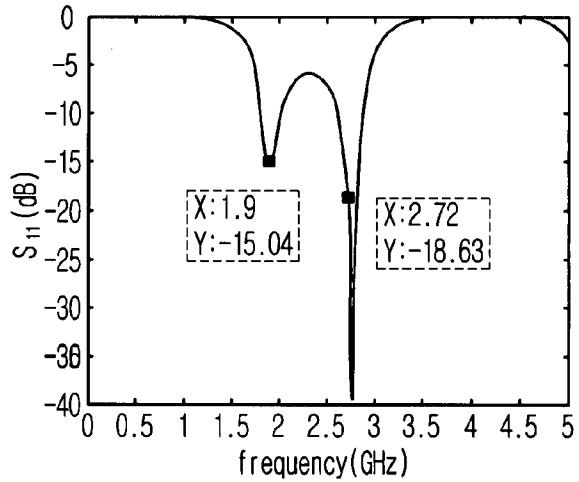

VERIFICATION 1 OF DESIGNING PROGRAM ACCORDING TO THE PRESENT INVENTION (DUAL BAND)

—— DESIGNING PROGRAM ACCORDING TO THE PRESENT INVENTION

—— CEM PROGRAM (large prove)

—— CEM PROGRAM (medium prove)

—— CEM PROGRAM (small prove)

VERIFICATION 2 OF DESIGNING PROGRAM ACCORDING TO THE PRESENT INVENTION (WIDE BAND)

—— DESIGNING PROGRAM ACCORDING TO THE PRESENT INVENTION

—— CEM PROGRAM (large prove)

—— CEM PROGRAM (medium prove)

—— CEM PROGRAM (small prove)

FIG. 10A
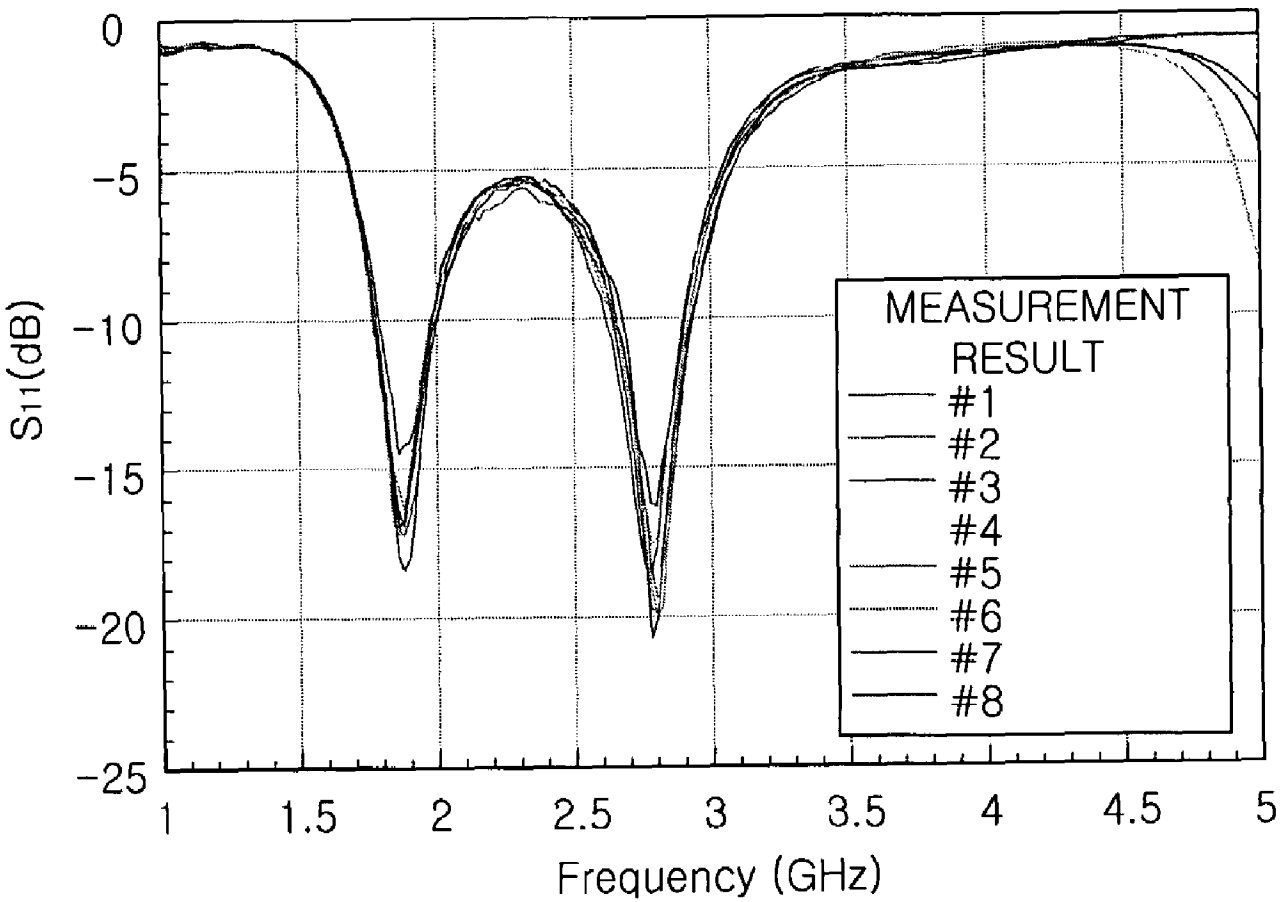
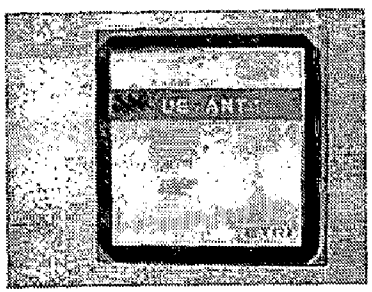

FIG. 10B
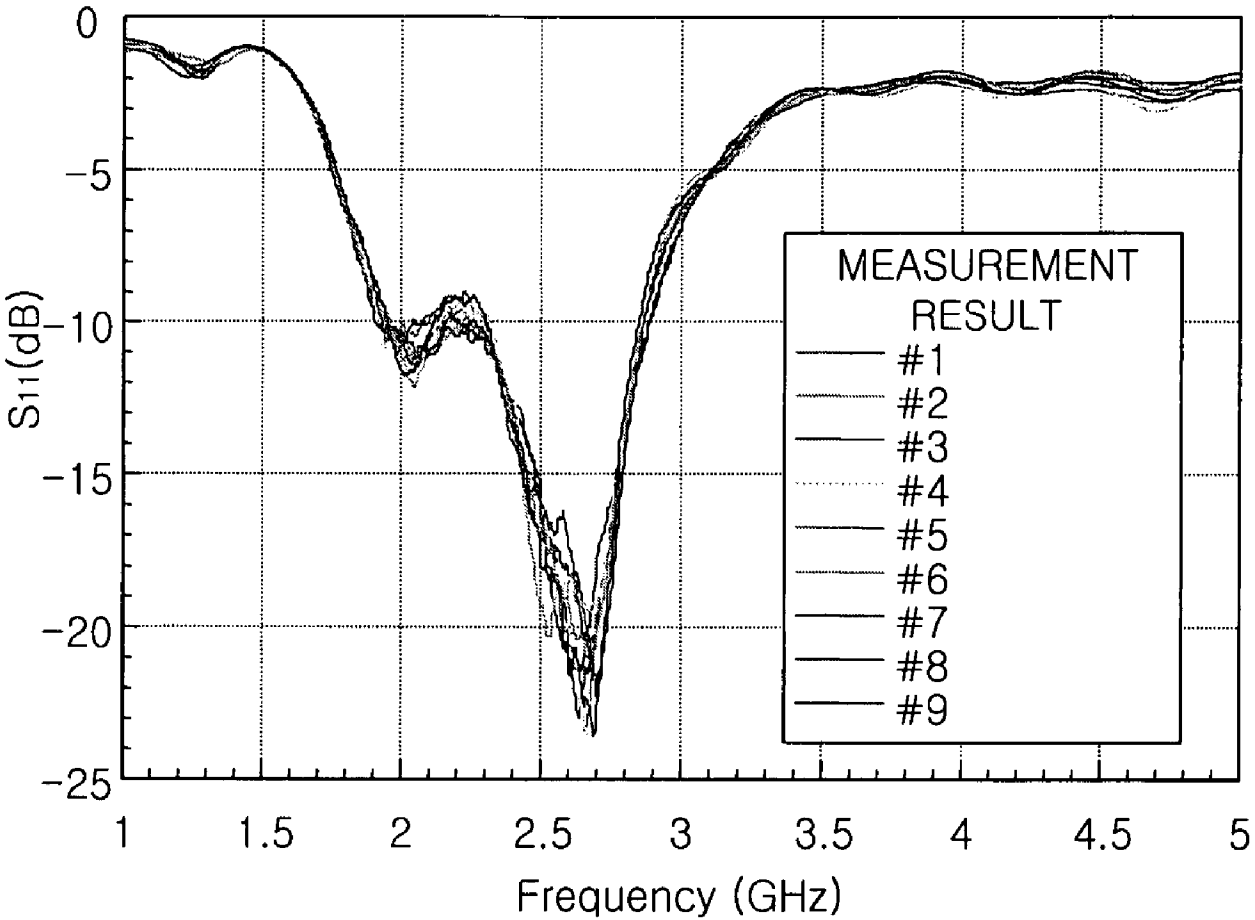
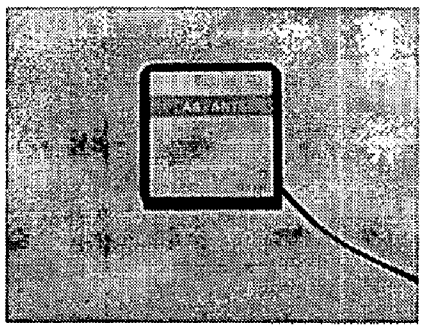

STUB PRINTED DIPOLE ANTENNA (SPDA) HAVING WIDE-BAND AND MULTI-BAND CHARACTERISTICS AND METHOD OF DESIGNING THE SAME

FIELD OF THE INVENTION

The present invention relates to a stub printed dipole antenna (SPDA) and a method of designing the same; and, more particularly, to a stub printed dipole antenna (SPDA) including a printed dipole radiator and a parallel metal strip line with a stub for obtaining a wide-band or a multi-band characteristic through dynamically using a combination of the printed dipole radiator, the parallel metal strip line and the stub, and a method of designing the same for reducing the number of trials and errors to design a stub printed dipole antenna by providing a design program of determining whether a required impedance characteristic such as a wide-band or a dual-band characteristic is created or not and determining what value must be set for an initial design value as a size of each part of the proposed antenna if the required characteristic is created.

DESCRIPTION OF RELATED ARTS

Hereinafter, a general knowledge about a stub will be described.

A stub is a line additionally coupled to a signal transmission line to tune impedance and to provide a wide-band characteristic. Such a stub is generally used for the impedance matching in a circuit configured of a microstrip or a strip line. The stub is generally classified into a shunt stub and a series stub. The shunt stub is further classified into an open stub and a short stub.

Hereinafter, a stub printed dipole antenna according to the present invention will be described to include an open stub as a stub. However, the present invention is not limited by the open stub.

Generally, a conventional printed dipole antenna includes two arms etched at a substrate. The conventional printed dipole antenna has various advantages such as a simple structure, easy fabrication, low profile due to a thin film structure, and high polarization purity. The impedance bandwidth of the conventional printed dipole antenna depends on the width of a dipole arm. That is, the wider the arm of the dipole is, the wider the bandwidth becomes. However, it is impossible to widen the arm of the dipole to obtain the wider bandwidth without any limitation because the discontinuity between the arm and the transmission line becomes greater. Therefore, the impedance bandwidth is generally about a 10 percent bandwidth when a standing wave ratio is less than 2:1. That is, the conventional dipole antenna generally has a relatively wide impedance bandwidth. Therefore, the conventional dipole antenna has been widely used as a wireless communication antenna and a military antenna.

There have been many researches to develop a printed dipole antenna to provide a wide-band characteristic or a dual-band characteristic with a simple structure. The present invention is also one of these researches. A printed dipole as a radiator and a parallel metal strip line for feeding electromagnetic power are commonly used in the previous researches and the present invention also use those common of the printed dipole antenna. However, the present invention is distinguished from the previous researches and provides a design program based on an equivalent transmission line model of the proposed structure to allow systematic design.

As a first conventional printed dipole antenna, a flat antenna having a simple structure providing a dual-band characteristic was introduced in U.S. Pat. No. 6,791,506, entitled "Dual band single feed dipole antenna and method of making the same." The first conventional printed dipole antenna has two dipoles. A first dipole is fed and a second dipole is formed on the first dipole. The stub printed dipole antenna according to the present invention is distinguished from the first conventional printed dipole antenna in a view of the basic operating principle to obtain a dual-band characteristic as well as the different shape such as the number of dipole and an open stub.

As a second conventional printed dipole antenna, a flat antenna having a simple structure to obtain a wide-band characteristic or a dual-band characteristic was introduced in an article by Faton Tefiku and Craig A. Grimes, entitled "Design of broad-band and dual-band antennas comprised of series-fed printed-strip dipole pairs", in IEEE transactions on Antennas and Propagation, Vol. 48, pp. 895-900, June, 2000. The second conventional printed dipole antenna uses two dipoles and obtains a wide-band characteristic or a dual-band characteristic through a combination of the two dipoles and a transmission line for feeding electro-magnetic power. Differently from the second conventional printed dipole antenna, the stub printed dipole antenna according to the present invention uses single dipole, a transmission line having an open stub for feeding, and obtains a wide-band characteristic or a dual-band characteristic through controlling a combination thereof such as the length of a dipole, the length of a transmission line, the length of an open stub and the impedance of the transmission line. Therefore, the stub printed dipole antenna according to the present invention is distinguished from the second conventional printed dipole antenna in a view of the basic operating principle to obtain a wide-band characteristic and a dual-band characteristic as well as the different shape such as the number of dipole and an open stub.

As a third conventional printed dipole antenna, a flat antenna having a simple structure providing a dual-band characteristic was introduced at an article by H, M, Chen et al, entitled "Feed for dual-band printed dipole antenna", in Electronics letters, Vol. 40, pp. 1320-1322, October, 2004. The third conventional printed dipole antenna is configured of a single dipole and a spur-line. However, the stub printed dipole antenna according to the present invention uses a single dipole and a transmission line having an open stub for feeding, and also obtains a wide-band characteristic or a dual-band characteristic through controlling a combination thereof such as the length of a dipole, the length of a transmission line, the length of an open stub and the impedance of the transmission line. Therefore, the stub printed dipole antenna according to the present invention is distinguished from the third conventional printed dipole antenna in a view of the basic operating principle to obtain a dual-band characteristic as well as the different shape such as a spur-line and an open stub.

As a fourth conventional printed dipole antenna, a flat antenna having a simple structure to obtain a wide-band characteristic was introduced in an article by Guan-Yu Chen and Jwo-Shiun Sun, entitled "A printed dipole antenna with microstrip tapered balun", in Microwave and Optical Technology Letters, Vol. 40, pp. 344-346, February, 2004. The fourth conventional printed dipole antenna is configured of a single dipole and includes additional transition at a feed line. On the contrary, the stub printed dipole antenna according to the present invention includes a single dipole and a transmission line having an open stub for feeding, and also obtains a wide-band characteristic or a dual-band characteristic through controlling a combination thereof such as the length of a dipole, the length of a transmission line, the length of an open stub and the impedance of the transmission line. That is, the stub printed dipole antenna according to the present invention does not include an additional transition at a feed line. Therefore, the stub printed dipole antenna according to the present invention is distinguished from the fourth conventional printed dipole antenna in a view of the basic operating principle to obtain a wide-band characteristic as well as the different shape such as a transition at a feed line and an open stub.

Most of the related researches for printed dipole antennas use a commercial computational electro-magnetics (CEM) program to design an antenna by analyzing the entire antenna structure. But, the present invention proposes a design program based on an equivalent transmission line model of the proposed antenna structure to allow systematic design.

SUMMARY OF THE INVENTION

It is, therefore, an object of the present invention to provide a stub printed dipole antenna including a printed dipole radiator and a parallel metal strip line with a stub for obtaining a wide-band or a multi-band characteristic through dynamically using a combination of the printed dipole radiator, the parallel metal strip line and the stub, and a method of designing the same for reducing the number of trials and errors to design a stub printed dipole antenna by providing a design program.

In accordance with an aspect of the present invention, there is provided a stub printed dipole antenna including: a substrate; dipole arms disposed at both surfaces of the substrate for transmitting/receiving a signal; a parallel metal strip line disposed at both surfaces of the substrate, and each having one end connected to each of the dipole arms; a stub disposed at both surfaces of the substrate, and connected to the other end of the parallel metal strip line; a coaxial probe connected to the junction of the parallel metal strip line and the stub for feeding signals; a hole for inserting an inner conductor of the coaxial probe; and a contact for connecting to an outer conductor of the coaxial probe.

In accordance with an aspect of the present invention, there is also provided a method of designing a stub printed dipole antenna including a substrate, dipole arms disposed at both surfaces of the substrate for transmitting/receiving a signal, a parallel metal strip line disposed at both surfaces of the substrate, and each having one end connected to each of the dipole arms, a stub disposed at both surfaces of the substrate, and connected to the other end of the parallel metal strip line, a coaxial probe connected to the junction of the parallel metal strip line and the stub for feeding signals, a hole for inserting an inner conductor of the coaxial probe, and a contact for connecting to an outer conductor of the coaxial probe, the method including the steps of: a) obtaining design value sets from a design program if the design program determines that the required specification is created using a stub printed dipole antenna, where design value set includes the length of the dipole arm, the length of the parallel metal strip line and the stub, and the length of the stub those satisfy required specifications; b) determining the initial design value set among the obtained design value sets, which is decided by a reflection coefficient characteristic according to a frequency of each design value set; c) analyzing and detailed-tuning the stub printed dipole antenna of the determined design value set using a computational electro-magnetics (CEM) program; and d) manufacturing the designed stub printed dipole antenna and measuring characteristics thereof if the analyzing result satisfies the required specification.

BRIEF DESCRIPTION OF THE DRAWINGS

The above and other objects and features of the present invention will become better understood with regard to the following description of the preferred embodiments given in conjunction with the accompanying drawings, in which:

FIG. 2 is an equivalent transmission line model, which shows design parameters of an open stub printed dipole antenna in accordance with a preferred embodiment of the present invention;

FIGS. 3 to 5 are views showing a step that extracts $Z_{dipoe}(f,A)$, $Z_{open}(f)$, $\gamma(f)$ as a preparation step to design an open stub printed dipole antenna systematically using a design program in accordance with a preferred embodiment of the present invention;

FIG. 6 is a view showing an example of using a design program for designing an open stub printed dipole antenna in accordance with a preferred embodiment of the present invention;

FIGS. 10A and 10B are pictures of open stub printed dipole antennas manufactured according to the designing method of FIG. 9 with two design specifications and results of measuring characteristics after manufacturing.

DETAILED DESCRIPTION OF THE INVENTION

Hereinafter, a stub printed dipole antenna (SPDA) and a method of designing the same in accordance with a preferred embodiment of the present invention will be described in more detail with reference to the accompanying drawings.

Figure 1A:
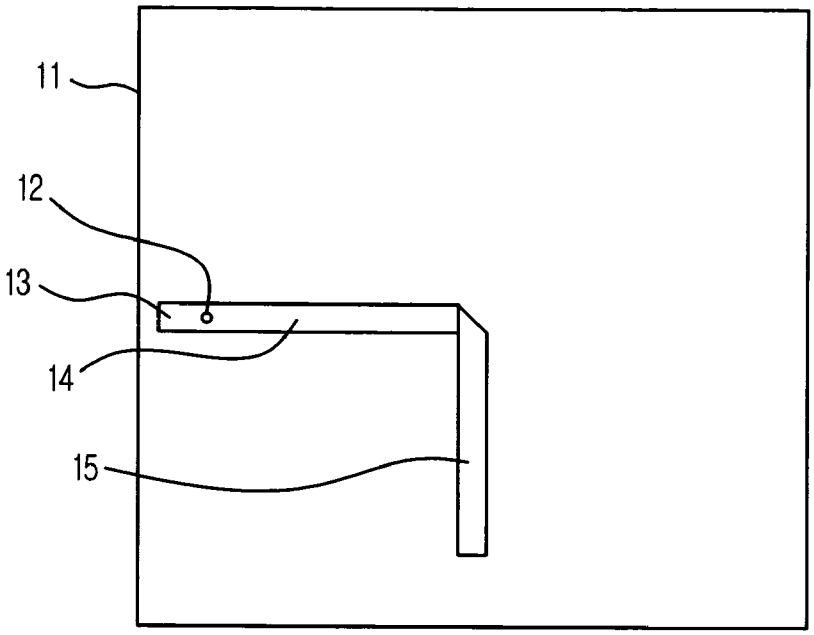
FIGS. 1A and 1B are a view illustrating an open stub printed dipole antenna in accordance with a preferred embodiment of the present invention.
Figure 1B:
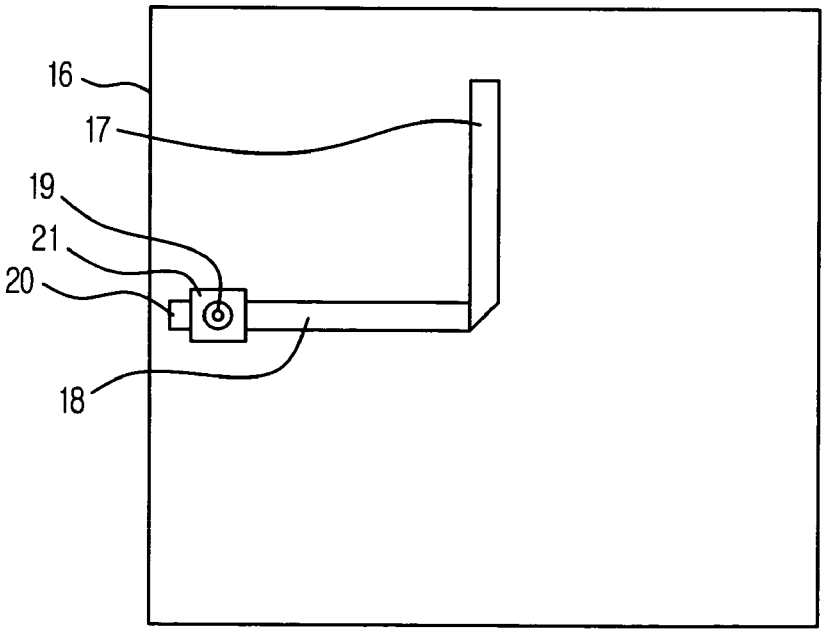

FIGS. 1A and 1B are a view illustrating an open stub printed dipole antenna in accordance with a preferred embodiment of the present invention. In the FIGS. 1A and 1B, a coaxial probe for feeding electro-magnetic power is not shown.

In more detail, FIG. 1A shows a first surface of a substrate in the open stub printed dipole antenna in accordance with a preferred embodiment of the present invention, which is a view of a top surface transparently shown through the substrate from the below of the substrate. FIG. 1B shows a second surface of a substrate in the open stub printed dipole antenna in accordance with a preferred embodiment of the present invention, which is a view of a bottom surface. The structures shown in FIGS. 1A and 1B are operated together.

As shown in FIGS. 1A and 1B, the open stub printed dipole antenna according to the preferred embodiment includes: a substrate having a top surface 11 and a bottom surface 16; printed dipole arms 15 and 17 for transmitting/receiving signals; a parallel metal strip line 14 and 18 connected to the dipole arms 15 and 17, respectively; an open stub 13 and 20 connected to the parallel metal strip line 14 and 18; a hole 12 and 19 for inserting an inner conductor of a coaxial probe; and a square contact 21 for connecting to an outer conductor of the coaxial probe.

FIG. 2 is an equivalent transmission line model, which shows design parameters of a stub printed dipole antenna in accordance with a preferred embodiment of the present invention.

As shown in FIG. 2, the open stub printed dipole antenna according to the present invention is designed using following design parameters such as the relative permittivity of a substrate ($\epsilon_r$) 22, the thickness of the substrate (h) 23, the width of a transmission line ($W_F$) 24, the width of arm ($W_A$) 25, the length of arm (A) 26, the length of the transmission line and an open stub (F) 27, the length of the open stub (R) 28 and the impedance of the transmission line ($Z_t$).

In FIG. 2, the reflection coefficient in an open load and a dipole is expressed as Eq. 1, and the impedance of the dipole and the open stub from a view of a feeding point is expressed as Eq. 2. Therefore, the input impedance and the reflection coefficient at the antenna input port is expressed as Eq. 3.

$$\Gamma_{dipole}(f, A, Z_t) = \frac{Z_{dipole}(f, A) - Z_t}{Z_{dipole}(f, A) + Z_t} \qquad \text{Eq. 1}$$

$$\Gamma_{open}(f, Z_t) = \frac{Z_{open}(f) - Z_t}{Z_{open}(f) + Z_t}$$

In Eq. 1, $Z_{dipole}$(f,A) denotes the dipole impedance from a view of the transmission line as shown in FIG. 2. $Z_{open}$(f) is the open stub impedance from a view of the transmission line.

$$Z_1(f, A, F, R, Z_t) = Z_t \cdot \frac{1 + \Gamma_{dipole}(f, A, Z_t) \cdot \exp[-2\gamma(f) \cdot (F - R)]}{1 - \Gamma_{dipole}(f, A, Z_t) \cdot \exp[-2\gamma(f) \cdot (F - R)]} \qquad \text{Eq. 2}$$

$$Z_2(f, R, Z_t) = Z_t \cdot \frac{1 + \Gamma_{open}(f, Z_t) \cdot \exp[-2\gamma(f) \cdot R]}{1 - \Gamma_{open}(f, Z_t) \cdot \exp[-2\gamma(f) \cdot R]}$$

In Eq. 2, γ(f) denotes the propagation constant of the transmission line.

$$Z_A(f, A, F, R, Z_t) = Z_1(f, A, F, R, Z_t) \,//\, Z_2(f, R, Z_t) \qquad \text{Eq. 3}$$

$$\Gamma(f, A, F, R, Z_t) = \frac{Z_A(f, A, F, R, Z_t) - Z_o}{Z_A(f, A, F, R, Z_t) + Z_o}$$

As shown in Eqs. 1 to 3, various frequency characteristics, where a frequency characteristic means a reflection coefficient according to a frequency, can be created through changing the parameters A, F, R and $Z_t$. That is, Γ(f) can be controlled according to a function with the major parameters A, F, R and $Z_t$ as like as Eq. 3 by dynamically using an open stub. Also, it is possible to create a target frequency characteristic such as a wide-band and a dual-band by changing the major parameters. Since Γ(f) can be expressed as a simple equation Eq. 3 using an equivalent model, it is very easy to check whether the proposed structure of an antenna can provide the target frequency characteristic or not, and what values must be set as the major parameters if the target frequency characteristic is provided.

If the length of the transmission line is only changed without using the open stub, the input impedance is rotated along a circle of a constant voltage standing wave ratio in a smith chart. In this case, the reflection coefficient at an input port is expressed as a function of the parameters A and $Z_t$, only, and various frequency characteristics cannot be provided.

If it is possible to obtain $Z_{dipole}$(f,A), $Z_{open}$(f), γ(f) for a predetermined substrate, it is also possible to determine whether a target frequency characteristic can be obtained or not with Γ(f,A,F,R,$Z_t$) using the Eqs. 1 to 3. Furthermore, it is possible to determine what values must be set as the major parameters of the antenna according to the present invention if the target reflection coefficient can be obtained. Those are the basic operating principle of a design program according to the present invention. Using the design program according to the present invention, it is possible to determine whether the open stub printed dipole antenna according to the present invention can provide a target frequency characteristic or not by inputting the target frequency characteristic and one major parameter $Z_t$ into the design program. Then, the design program outputs sizes of three major parameters A, F, R of the open stub printed dipole antenna as a text file.

Figure 3:
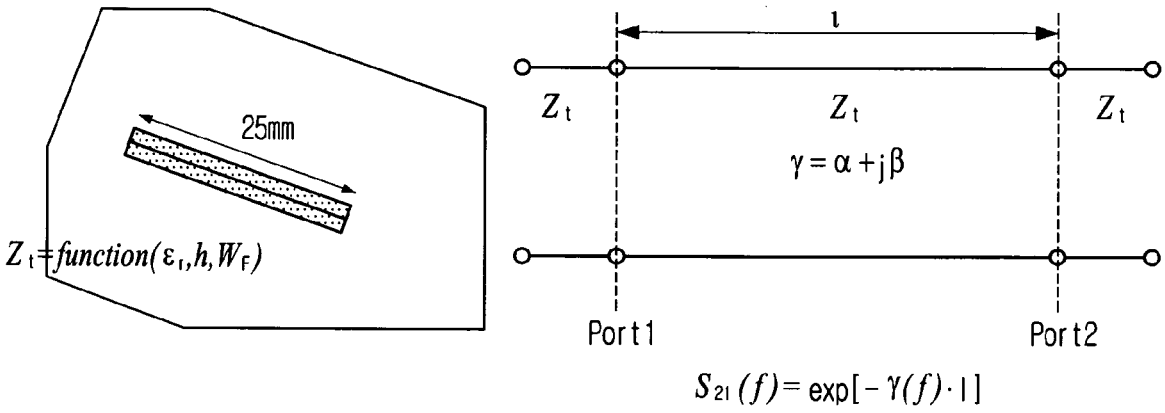
Figure 5:
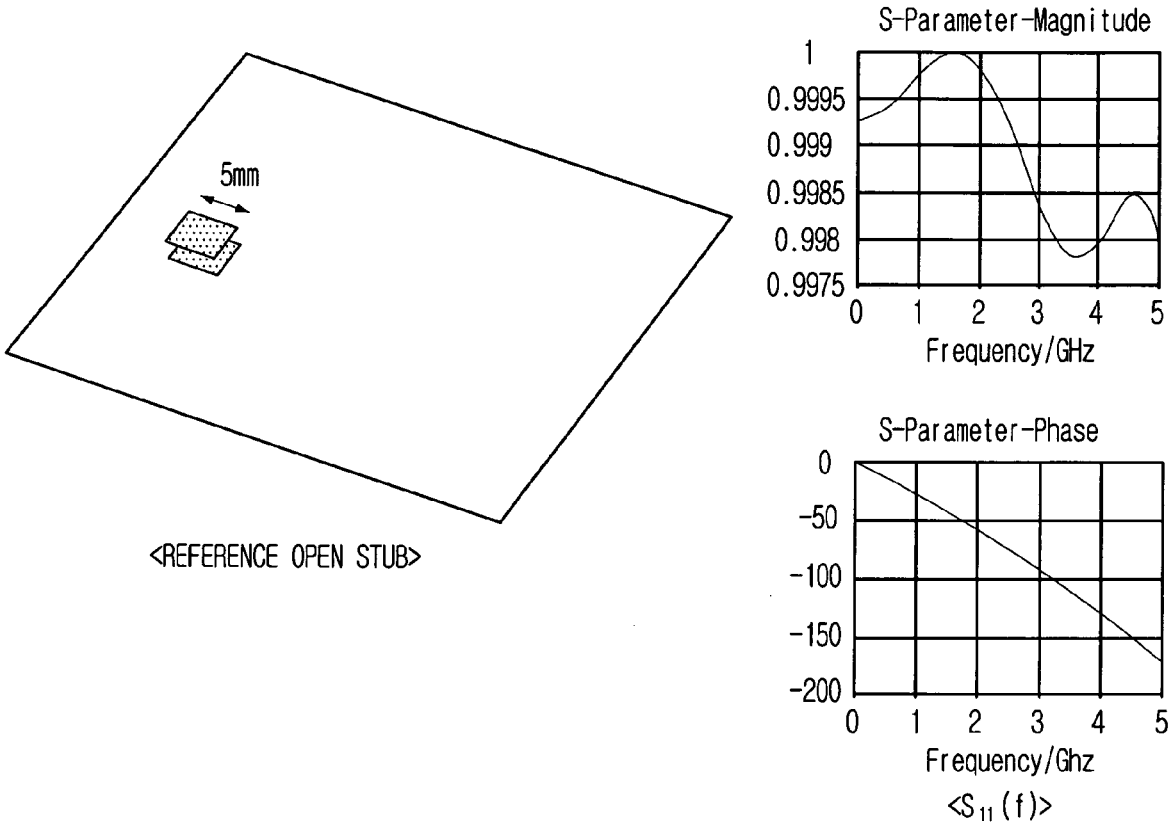

FIGS. 3 to 5 are views showing a step of extracting $Z_{dipole}$(f,A), $Z_{open}$(f), γ(f) as a preparation step to design an open stub printed dipole antenna systematically using a design program in accordance with a preferred embodiment of the present invention.

For a determined substrate, a step of extracting is required only once, and any CEM programs can be used in this extracting process.

FIG. 3 shows a step for extracting a propagation constant γ(f) of a transmission line. The propagation constant of the transmission line can be obtained through obtaining $S_{21}$ of a transmission structure shown in FIG. 3 by a calculation of a CEM program. $Z_{dipole}$(f,A) can be obtained by obtaining $S_{11}$ of a reference dipole structure shown in FIG. 4 through a calculation of CEM. $Z_{open}$(f) can be obtained by obtaining $S_{11}$ of a reference open stub structure shown in FIG. 5 through a calculation of CEM.

Herein, the extraction of the propagation constant γ(f) of the transmission line is performed once for a characteristic impedance $Z_t$ of a predetermined transmission line and the propagation constant γ(f) is used to the design program under the assumption that the propagation constant γ(f) is not related to the characteristic impedance $Z_t$ of a predetermined transmission line.

FIG. 6 is a view showing an example of using a design program for designing an open stub printed dipole antenna in accordance with a preferred embodiment of the present invention.

As shown in FIG. 6, if a user inputs operating frequencies, a maximum reflection coefficient allowed at the operating frequencies, and the impedance of a transmission line to the design program as "input 1", the design program generates a text file as "output 1". Herein, the operating frequencies are the center frequencies of each band in case of a dual-band. The generated text file "output 1" includes design value sets for an open stub printed dipole antenna according to the present invention and the maximum reflection coefficient at the operating frequencies for each set. Herein, a design value set includes the length (A) of a dipole arm, the length (F) of a parallel metal strip line and a stub, and the length (R) of the stub those satisfy required specifications.

Bandwidth of each band is also major factor. Therefore, if a user inputs the impedance $Z_t$ of the transmission line and one design value set among the design value sets obtained through the text file "output 1" as an "input 2", the reflection coefficient characteristic according to a frequency is outputted as a graph "output 2" for checking a bandwidth of each band. Accordingly, initial design value set (A, F, R) of a stub printed dipole antenna according to the present invention can be obtained by selecting one among the design value sets obtained through the text file "output 1".

Figure 7A:
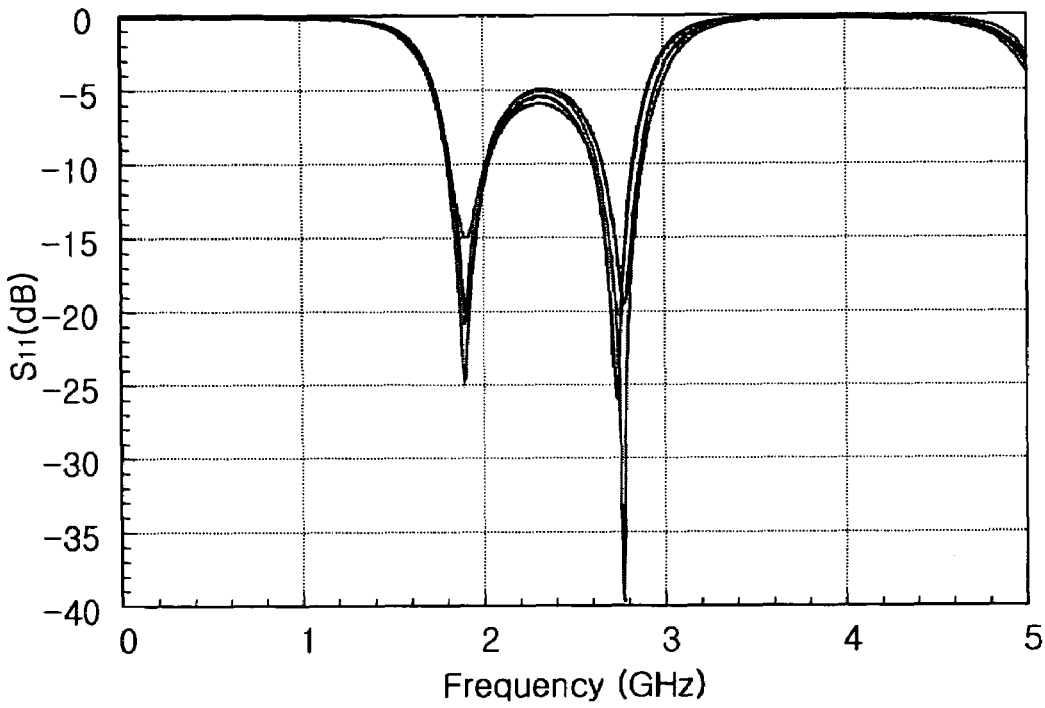
FIGS. 7A and 7B show comparisons between the reflection coefficient characteristic according to a frequency estimated through a design program according to the present invention and the reflection coefficient characteristic according to a frequency obtained through a computational electro-magnetics (CEM) program as a result of analyzing an antenna designed by the design program in order to verify an accuracy of the design program for designing a stub printed dipole antenna according to the present invention.
Figure 7B:
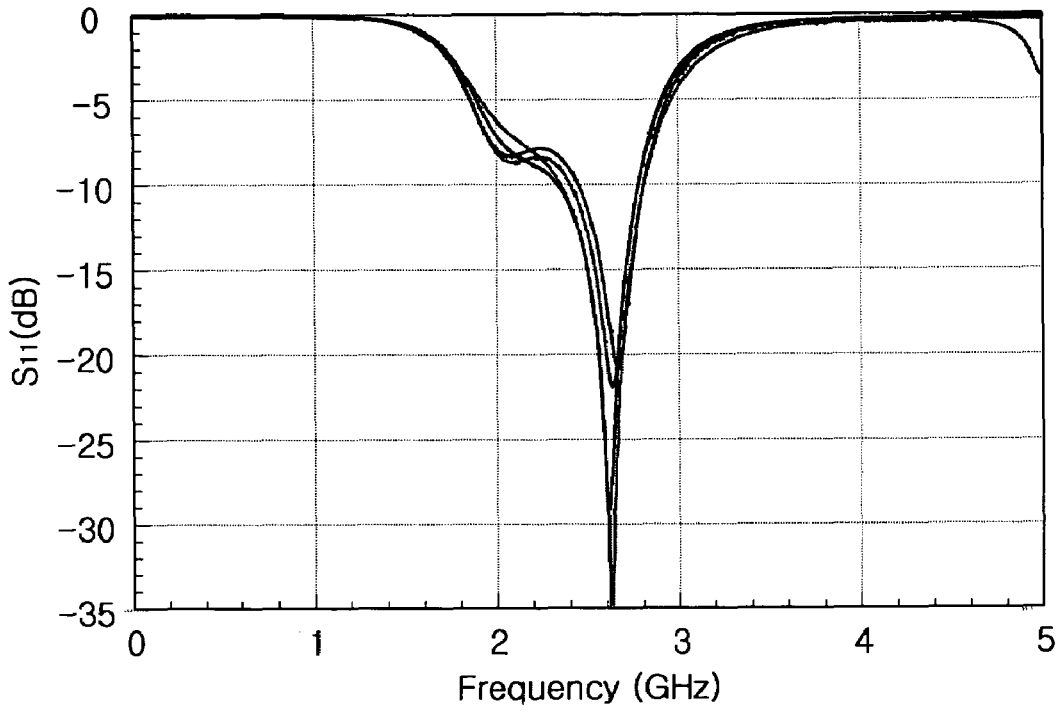

In order to verify an accuracy of the design program according to the present invention, the antenna obtained through the design program is analyzed through a CEM program and the result of analyzing is shown in a graph compared to the result of the design program in FIGS. 7A and 7B.

That is, FIGS. 7A and 7B show comparisons between the reflection coefficient characteristic according to a frequency estimated through a design program according to the present invention and the reflection coefficient characteristic according to a frequency obtained through a CEM program as a result of analyzing the antenna designed by the design program in order to verify an accuracy of the design program for designing a stub printed dipole antenna according to the present invention.

As shown in FIGS. 7A and 7B, the graphs show comparison results of dual-band as an example of multi-band, and wide-band. In FIGS. 7A and 7B, a small, a medium and a large probe denote a specification of a coaxial probe generally used for feeding, and a detail thereof is shown in a below table.

TABLE 1

| inner conductor diameter of 50 ohm coaxial connector for feeding | | |
|---|---|---|
| about 0.274 mm<br>small probe | about 0.504 mm<br>medium probe | about 1.270 mm<br>large probe |

diameter of dielectric material ≈ (diameter of inner conductor × 3.3)

Figure 8:
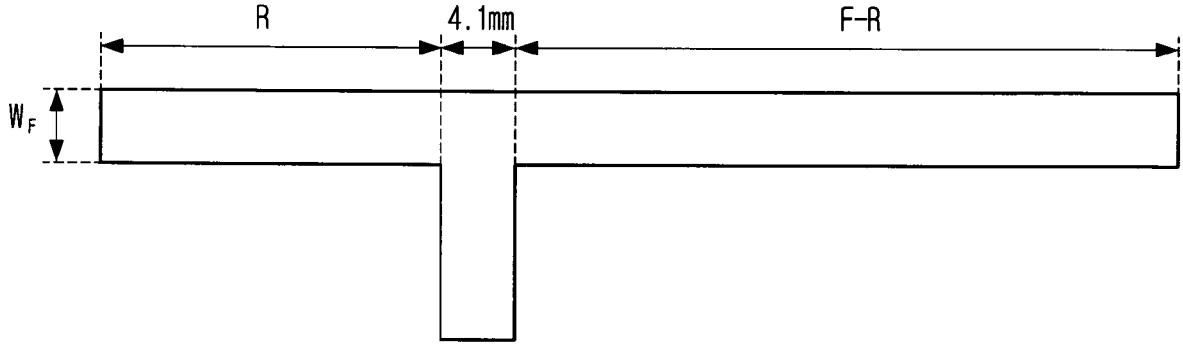
FIG. 8 is a view showing a compensation value about a coaxial probe for feeding in a stub printed dipole antenna in accordance with a preferred embodiment of the present invention.

FIG. 8 is a view showing a compensation value about a coaxial probe for feeding in a stub printed dipole antenna in accordance with a preferred embodiment of the present invention.

The length (F) of a transmission line and an open stub and the length (R) of the open stub are compensated by assuming a portion of coaxial probe for feeding as an transmission line having 4.1 mm width as shown in FIG. 8 when an initially designed stub printed dipole antenna through the design program according to the present invention is analyzed by the CEM program or fabricated. That is the length (F) of the transmission line and the open stub and the length (R) of the open stub, obtained through the design program, are corrected by adding 4.1 mm and 2.05 mm respectively.

Also, if an antenna case for protection or a reflector for directional pattern is needed, the reflection coefficient variation due to these objects is tuned using Eq. 4.

$$x_{original} = \frac{\text{length}}{\lambda_{original}} = \left(\frac{\text{length}\cdot\sqrt{\varepsilon_{eff(original)}}}{C}\right)f \qquad \text{Eq. 4}$$

$$x_{case,reflector} = \frac{\text{length}}{\lambda_{case,reflector}} = \left(\frac{\text{length}\cdot\sqrt{\varepsilon_{eff(original)}}}{C}\right)f\cdot\sqrt{\frac{\varepsilon_{eff(case,reflector)}}{\varepsilon_{eff(original)}}}$$

$$x_{compensate} = \frac{\text{length}\cdot s}{\lambda_{case,reflector}} = \left(\frac{\text{length}\cdot\sqrt{\varepsilon_{eff(original)}}}{C}\right)f\cdot\sqrt{\frac{\varepsilon_{eff(case,reflector)}}{\varepsilon_{eff(original)}}}\cdot s$$

Figure 9:
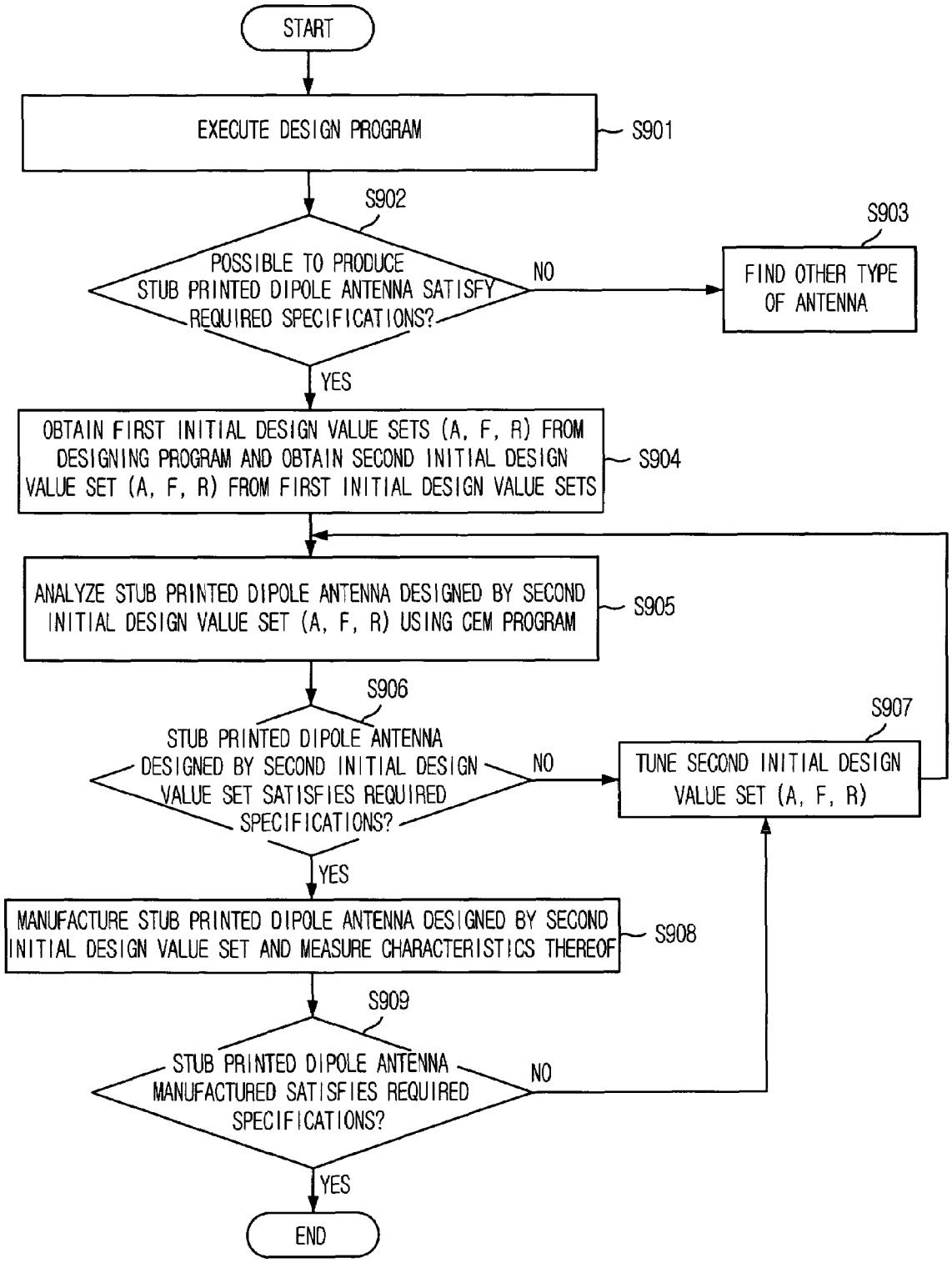
FIG. 9 is a flowchart showing a method of designing a stub dipole antenna in accordance with a preferred embodiment of the present invention.

FIG. 9 is a flowchart showing a method of designing an open stub printed dipole antenna in accordance with a preferred embodiment of the present invention.

At first, a design program for an open stub printed dipole antenna according to the present invention is executed at step S901, and it determines whether it is possible to satisfy requirements using an open stub printed dipole antenna at step S902.

If it is possible, design value sets that satisfy requirements and initial design value set as the selected one among the design value sets are obtained at step S904.

Then, the designed open stub printed dipole antenna applying the initial design value set (A, F, R) is analyzed by a CEM program at step S905.

The initial design value set is tuned at step S907 if it is judged that tuning is needed at step S906. Then, the step S905 for analyzing by the CEM program is performed again. Tuning and analyzing are performed repeatedly until the requirements are satisfied. Then, the designed open stub printed dipole antenna is manufactured and measured at step S908.

If it is judged that the measured results do not satisfy the requirements at step S909, a tuning is performed again.

On the contrary, if the measured results do satisfy the requirements, the design of the open stub printed dipole antenna that satisfies the requirements is terminated.

FIGS. 10A and 10B are pictures of open stub printed dipole antennas manufactured according to the designing method of FIG. 9 with two design specifications and results of measurement after manufacturing. Two antennas have cases and an antenna for second specification has a reflector.

Herein, design specification denotes requirements and they are as like follows.

A first design specification requires a multi-band at 1.90 GHz and 2.72 GHz, and a 70 MHz bandwidth for each band. A second design specification requires a wide-band from 2.50 GHz to 2.70 GHz.

FIG. 10A shows a picture of one of 8 open stub printed dipole antennas manufactured to satisfy the first design specification and results of measurements of 8 open stub printed dipole antennas, and FIG. 10B shows a picture of one of 9 open stub printed dipole antennas manufactured to satisfy the second design specification and results of measurements of 9 open stub printed dipole antennas.

As shown in FIGS. 10A and 10B, the results of measurements show that the 8 open stub printed dipole antennas manufactured to satisfy the first design specification provide similar $S_{11}$ characteristics each other and satisfy the first design specification, and the 9 open stub printed dipole antennas manufactured to satisfy the second design specification do also.

Figure 11A:
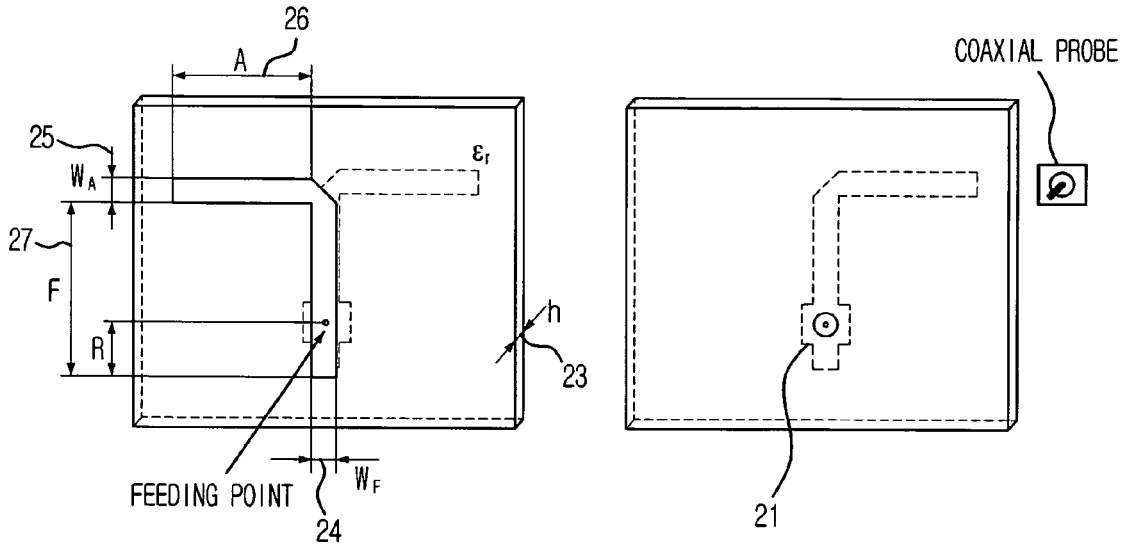
FIGS. 11A and 11B show an entire structure of an open stub printed dipole antenna including a coaxial probe, an open stub, a transmission line and a connection of them, and the detail structure of the coaxial probe in accordance with a preferred embodiment of the present invention.
Figure 11B:
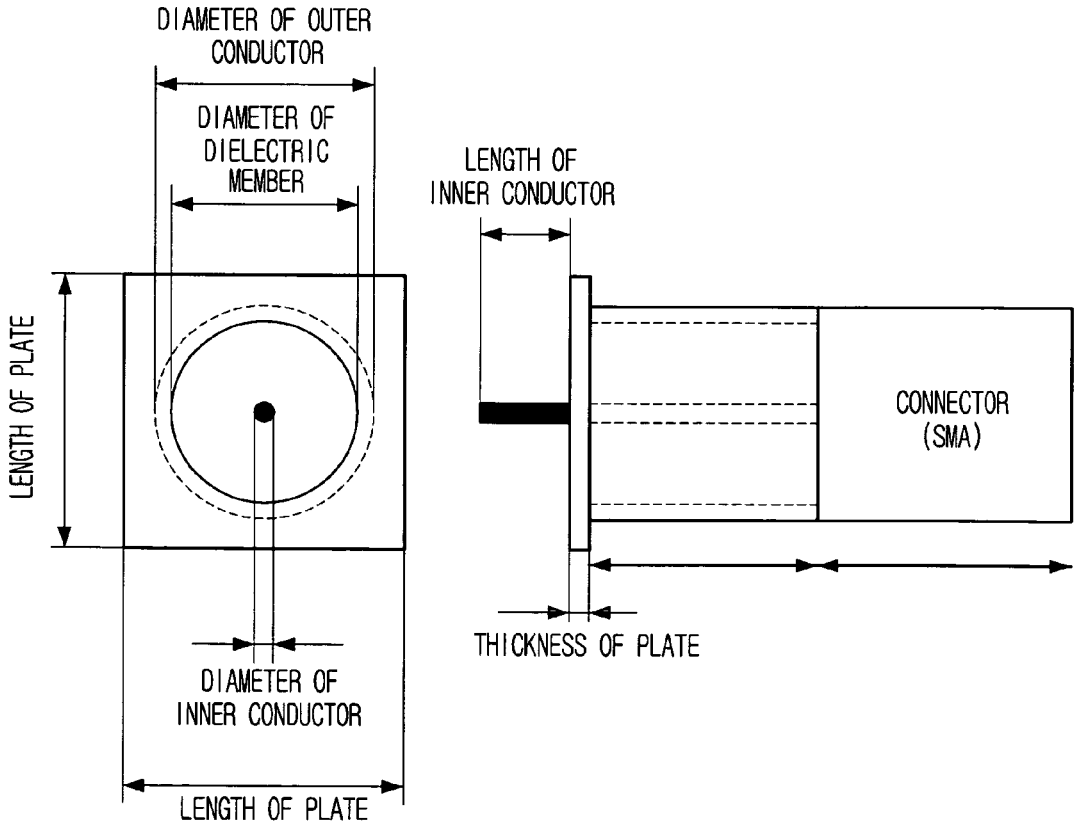

FIGS. 11A and 11B show an entire structure of an open stub printed dipole antenna including a coaxial probe, an open stub, a transmission line and a connection thereof, and the detail structure of the coaxial probe in accordance with a preferred embodiment of the present invention.

As shown in FIGS. 11A and 11B, the connection between the open stub, the parallel metal strip line, and the coaxial probe for feeding in the present invention does not require an additional balun.

As described above, an open stub printed dipole antenna according to the present invention has a simple structure, and creates various frequency characteristics. Therefore, an open stub printed dipole antenna according to the present invention provides a wide-band or a multi-band characteristic.

Also, the structure of an open stub printed dipole antenna according to the present invention has the dominant design parameters that vary characteristic thereof and the number of the dominant design parameters is very suitable to embody a design program. Furthermore, it is easy to analyze what parameters influence the proposed antenna characteristic and how the antenna characteristic is influenced by the parameters. Moreover, the structure of the antenna according to the present invention is very small.

The present invention also provides the design program for designing the open stub printed dipole antenna according to the present invention. The design program according to the present invention can determine whether a required frequency characteristic such as a wide-band or a dual-band is created or not and determine what values must be set for the initial design values if the required characteristic can be created. Therefore, the present invention allows a systematic design of the open stub dipole antenna and also reduces the number of trials and errors through the systematic design.

The pattern of the stub printed dipole antenna according to the present invention is an omni-directional pattern of a typical dipole. Moreover, the stub printed dipole antenna according to the present invention can be embodied for a directional pattern by using a reflector. That is, the stub printed dipole antenna according to the present invention can be embodied not only for the omni-directional pattern but also for a directional pattern.

The present application contains subject matter related to Korean patent application No. KR 2005-0076503, filed in the Korean patent office on Aug. 19, 2005, and Korean patent application No. KR 2005-0108100, filed in the Korean patent office on Nov. 11, 2005, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. A stub printed dipole antenna comprising:

a substrate having a relative permittivity;

dipole arms disposed at both surfaces of the substrate for transmitting/receiving a signal, wherein each dipole arm has a length of A and a width of $W_A$;

parallel metal strip lines disposed at both surfaces of the substrate, and each having one end connected to each of the dipole arms, wherein each metal strip line, has a length of (F-R) and a width of $W_F$;

a stub disposed at both surfaces of the substrate, and connected to the other end of the parallel metal strip lines wherein the stub has the width of the strip lines being $W_F$ and a length R extending in the linear direction of the parallel metal strip lines;

a coaxial probe connected to the junction of the parallel metal strip lines and the stub for feeding signals;

a hole for inserting an inner conductor of the coaxial probe; and a contact for connecting to an outer conductor of the coaxial probe.

2. The stub printed dipole antenna as recited in claim 1, wherein the stub printed dipole antenna has a structure not requiring a balun for feeding electro-magnetic power.

3. The stub printed dipole antenna as recited in claim 1, wherein a wide-band characteristic or a multi-band characteristic is obtained by controlling the length of the dipole arm, the length of the parallel metal strip line, the length of the stub and the impedance of the parallel metal strip line.

4. The stub printed dipole antenna as recited in claim 1, wherein the parallel metal strip lines and the stubs formed on both surfaces of the substrate overlap each other respectively.

5. The stub printed dipole antenna as recited in claim 4, wherein the dipole arms formed on both surfaces of the substrate do not overlap each other.

6. The stub printed dipole antenna as recited in claim 1, the dipole arm having the length A is substantially perpendicular to the connected metal strip line formed on the same surface.

7. A method of designing a stub printed dipole antenna including a substrate, dipole arms disposed at both surfaces of the substrate for transmitting/receiving a signal, a parallel metal strip line disposed at both surfaces of the substrate, and each having one end connected to each of the dipole arms, a stub disposed at both surfaces of the substrate, and connected to the other end of the parallel metal strip line, a coaxial probe connected to the junction of the parallel metal strip line and the stub for feeding signals, a hole for inserting an inner conductor of the coaxial probe, and a contact for connecting to an outer conductor of the coaxial probe, the method comprising the steps of:

a) obtaining design value sets including the lengths of the dipole arm, lengths of the parallel metal strip line and the lengths of the stub that satisfy a predetermined antenna preformance requirement;

b) obtaining a initial design value set including the length of the dipole arm, the total length of the parallel metal strip line and the stub, and the length of the stub, which are decided by a reflection coefficient characteristic according to a frequency for each set of the design value sets;

c) analyzing and tuning the stub printed dipole antenna, of the initial design value set using a computational electro-magnetics (CEM) program; and d) manufacturing the stub printed dipole antenna designed and measuring characteristics thereof if the analyzing result substantially satisfies the predetermined antenna performance requirement.

8. The method of claim 7, wherein the stub printed dipole antenna is initially and automatically designed using a design program based on an equivalent transmission line model for the stub printed dipole antenna.

9. The method of claim 8, wherein the design program for the stub printed dipole antenna receives operating frequencies and a maximum reflection coefficient allowable at the operating frequencies according to a predetermined antenna performance requirement, and the impedance of the transmission line as a input, and outputs design value sets of the stub printed dipole antenna which satisfy the predetermined antenna performance requirement.

10. The method of claim 9, wherein the design value sets of the stub printed dipole antenna includes the lengths of the dipole arm, the lengths of the transmission line and the stub and the lengths of the stub.

11. The method of claim 8, wherein the design program for the stub printed dipole antenna outputs a reflection coefficient characteristic according to a frequency if a design value set among the design value sets and the Impedance of the transmission line are inputted.

* * * * *